US005272780A

United States Patent [19]

Clute

[11] Patent Number: 5,272,780

[45] Date of Patent: * Dec. 28, 1993

[54] INFANT SUPPORT PILLOW

[76] Inventor: Jason Clute, 3401 Deer Ridge Dr., Danville, Calif. 94506-6047

[ * ] Notice: The portion of the term of this patent subsequent to Mar. 16, 2010 has been disclaimed.

[21] Appl. No.: 64,595

[22] Filed: May 21, 1993

[51] Int. Cl.[5] ..... A47D 13/08; A47D 15/00; A47G 9/00

[52] U.S. Cl. ..... 5/655; 5/632; 5/922

[58] Field of Search ..... 5/655, 657, 640, 630, 5/632, 465, 922, 603

[56] References Cited

U.S. PATENT DOCUMENTS

| | | | |
|---|---|---|---|
| 2,724,133 | 11/1955 | Sorrell . | |
| 3,763,509 | 10/1973 | Mittendorf | 5/640 |
| 3,924,282 | 12/1975 | Bond | 5/632 |
| 4,506,396 | 3/1985 | Ritchie, Jr. et al. | 5/631 |
| 4,579,111 | 4/1986 | Ledesma | 5/632 |
| 4,790,041 | 12/1988 | Shtull | 5/424 |
| 5,182,828 | 2/1993 | Alivizatos | 5/632 |
| 5,193,238 | 3/1993 | Clute | 5/655 |
| 5,216,772 | 6/1993 | Clute | 5/655 |

FOREIGN PATENT DOCUMENTS

| | | | |
|---|---|---|---|
| 1449012 | 7/1966 | France | 5/655 |

*Primary Examiner*—Alexander Grosz

[57] ABSTRACT

A support pillow having two resilient pads and a bottom panel connecting between the two pads. The two pads are in spaced relationship with one another so as to define a channel to receive an infant placed on its side within the channel. The infant's head and possibly arms extend out one open end of the channel, and his legs extend out the other oppositely disposed open end of the channel. The channel is defined by planar walls of the spaced pads. The planar walls of the pads are soft so as to be somewhat conformable to the natural curvature of the infant's body when the width of the channel is adjusted with the opposing planar walls pressed snugly against the infant, one wall against his back, and the other wall against his chest area. The planar walls support the body with wide surface area contact and thereby comfort and adequate holding pressures are gained. Capabilities for adjusting the width of the channel are provide with adjustable fasteners such as hook and loop.

3 Claims, 4 Drawing Sheets

INFANT SUPPORT PILLOW

BACKGROUND OF THE INVENTION

1. Field of the Invention:

The present invention relates to support pillows for humans in general, and in particular to a pillow which supports and maintains a human, particularly an infant, generally on his side while sleeping.

2. Description of the Prior Art:

There have been studies in the past which provide some evidence that supporting infants in certain positions during sleep may help to prevent the occurrence of Sudden Infant Death Syndrome, commonly referred to as SIDS. Some of the most recent information indicates that positioning the infant in a lateral position (on its side) during sleep may be the most desirable and helpful position in reducing the occurrence of SIDS. At this time there is no definitive diagnosis of the cause of SIDS, and it remains a serious problem with no known cure. Some theorize the infants simply suffocate possibly due to their not having enough strength to raise their heads off the mattress when in a prone position in order to avoid whatever obstacle is blocking their breathing. SIDS is more prevalent in the first six months of the infant's life, which adds support to the theory that the infant's underdeveloped motor skills may be a factor in SIDS deaths. Some believe placing infants on their backs can also be dangerous if they regurgitate formula and subsequently aspirate it into their lungs.

In the past, some parents have positioned infants on their sides with the use of bed pillows or rolled blankets propped against the back and or front of the infant, primarily for the purpose of allowing the infant to nurse from a bottle more easily. However, bed pillows and rolled blankets tend to become easily dislodged as the infant moves about, and are generally ineffective in maintaining the infant in a true lateral position. The dislodged bed pillows and blankets also pose the potential danger of covering the infant's face and interfering with its breathing.

While there have in the past been child support pillows provided for supporting an infant on its back in a semi-lateral position, normally there is no frontal support to prevent the child from rolling over onto its stomach. None of the existing support pillows are properly adjustable to accommodate the various sizes of infants, or are readily portable or machine washable. Therefore there is a significant need for a suitably structured support pillow for use with infants which may reduce the occurrence of SIDS.

A support pillow somewhat similar to the present invention may be found taught in U.S. Pat. No. 5,193,238 for Infant Support Pillow, and issued Mar. 16, 1993 to myself, L. Jason Clute. My prior patent teaches a support pillow utilizing two triangulated pillows in spaced relationship to define a channel, and it additionally includes structure for adjusting the width of the channel, and therefore my prior patent 5,193,238 is herein incorporated by reference for both essential and non-essential material. My invention of my prior patent utilizes vertically oriented planar side walls to define a channel in which the infant is laid on its side, and although this functions suitably well, changes could still be made in the areas of providing safety, adequate support and comfort for the baby in a device which may be manufactured and sold inexpensively.

SUMMARY OF THE INVENTION

The present invention is a support pillow primarily for use with infants, to securely maintain an infant on its side during sleep and thus hopefully reduce the risk of SIDS, while also providing a high level of safety and comfort in a device which may be manufactured inexpensively. My support pillow preferably has two triangular resilient pads and a bottom panel connecting between the two pads. The two pads are in spaced relationship with one another so as to define an open top and open ended channel to receive an infant placed on its side within the channel. The infant's head and possibly arm(s) extends out one open end of the channel, and his legs extend out the other oppositely disposed open end of the channel. The support pillow is preferably structured to allow the baby to draw his legs upward toward his chest somewhat into a semi-fetal position. The channel is preferably defined by sloped planar side walls of the pads angling downward toward the bottom panel between the pads, and defining a V-shaped channel. The planar sloped walls of the pads are sufficiently soft so as to be somewhat conformable to the natural curvature of the infant's body, particularly near the bottom panel, when the width of the channel is adjusted with the opposing planar sloped walls pressed snugly against the infant, one sloped wall against his back, and the other sloped wall against his chest area. A small gap is provided and the bottom panel is exposed in the bottom of the V-shaped channel so as to provide a generally flat area on which the baby may rest, and this eliminates an uncomfortable pinching arrangement which might exist if the baby was positioned on his side in an increasingly narrow V-shaped channel that didn't have a somewhat flat bottom at the bottom of the channel.

The soft planar sloped walls support the baby with wide surface area contact and thereby comfort and adequate holding pressures are gained. Capabilities for adjusting the width of the channel are provided with adjustable fasteners such as hook and loop fasteners.

The triangular pads having sloped planar walls are of a shape rendering quick and inexpensive manufacturing thereof. The planar walls are an inexpensive shape, providing for the cutting of the triangular pads out of rectangular bulk blocks of synthetic resilient foam (foam rubber). The planar walls defining the channel are sufficiently soft to conform to the curves of the infant's body, particularly near the bottom panel, and thereby wide surface area contact between the pad walls and the infant is provided, and this wide surface area contact with the resultant widely distributed pressures results in lower pressures at any given area of the infant being required to securely retain the infant on its side and still provide for a high degree of comfort. With the softness of the pads, and the low pressures per square inch applied to the infant, the infant is securely retained on its side, is very comfortable, and the infant's breathing is not inhibited by restrictive pressures against its back and chest or stomach.

It is an object of the present invention to provide a support pillow for a human, particularly an infant, which is structured to support the infant on its side. A further object of the invention is to provide the aforementioned object in a support pillow which supports the infant by contacting a relatively wide surface area so as to widely distribute pressure. A further object of the invention is to provide the aforementioned objects in a support pillow which is sufficiently soft. A still further object of the invention is to provide the aforementioned objects in a support pillow which is adjustable in order to accommodate various sizes of infants. A further object of the invention is to provide the aforementioned objects in a support pillow which is safe for use with an infant, and which does not restrict the normal breathing of the infant, and which is effectively flat on the bottom to prevent the infant and support pillow from rolling on a surface. A still further object of the invention is to provide the aforementioned objects in a support pillow which is washable, durable, lightweight, small, foldable or dismantlable and thus highly portable, and which may be manufactured quickly and inexpensively.

These and other objects will be better understood with continued reading.

DESCRIPTION OF THE PREFERRED EMBODIMENTS

Figure 1:
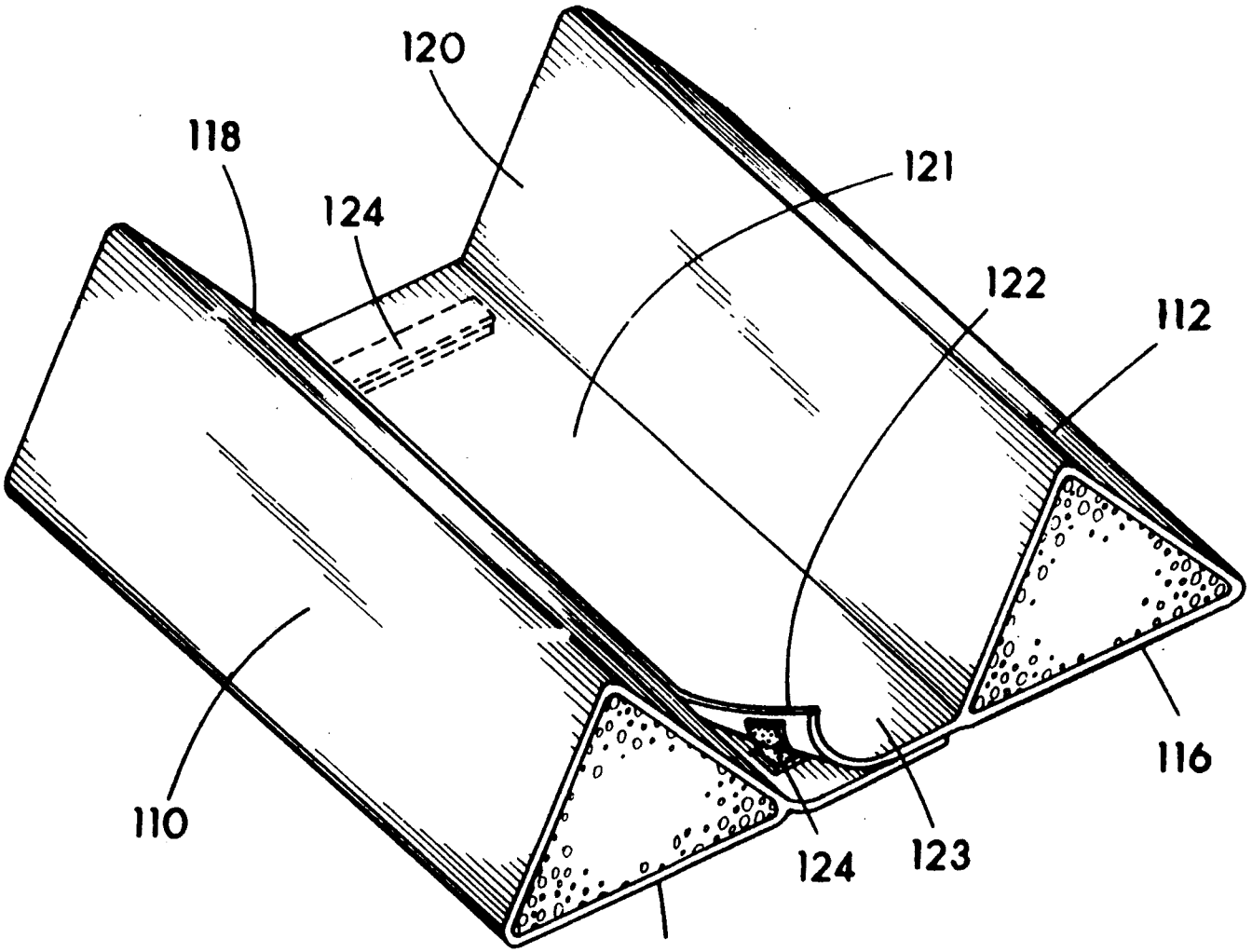
FIG. 1 is one structural embodiment in accordance with my invention.

Referring to the drawing FIGS. 1 through 4 where my present invention is shown. This description relies greatly on the reference patent for the teaching of structuring or possible structuring pertaining to rendering the support pillow of this disclosure light in weight, small and highly portable, and in the aspects of various possible ways in which the support pillow may be structured in order to provide it in a form which may be maintained clean, whether it be structured dismantlable and washable in separate pieces or washable as a single unit.

FIG. 1 is one structural embodiment in accordance with my present invention wherein the pads 110 and 112 are triangular in shape having flat bottoms or bases 114 and 116 and sloped planar side walls 118 and 120. The triangular shape of the pads is one which supplies the desired function and which is inexpensive to manufacture, although other shapes might also work. The elongated pads 110 and 112 are positioned parallel to one another with the side walls 118 and 120 parallel to one another and in spaced relationship to define a V-shaped channel 121 between the two pads. The two pads 110 and 112 are affixed stationary relative to one another with a center panel 122 which is connected between the pads at the bases 114 and 116. Center panel 122 in this example is made of flexible fabric, and further, is two pieces of overlapped fabric having hook and loop fasteners 124 as taught in the reference patent to allow adjustability of the width of the channel 121. The V-shaped channel 121 is sized to allow an infant to be placed on his side within the channel and to be maintained on his side. The height of which the pads 110 and 112, and specifically side walls 118 and 120 rise upward above the center panel 122 should be at least equal to one-third the width of the infant across the infant from shoulder to shoulder in order to support high enough up on the baby's body to prevent him from rolling over the tops of the pads and out of the support pillow. The infant when in the support pillow is prevented from rolling and carrying the support pillow with the roll by the wide generally flat plane base provided by the combination of the bases 114 and 116 plus the weight of the infant on center panel 122. The sloped planar walls 118 and 120 are spaced such that a gap 123 is provided between the bases or pads in the bottom of the V-shaped channel wherein a portion of the center panel 122 is exposed, with this generally flat area eliminating an uncomfortable pinching arrangement which might exist if the baby was positioned on his side in an increasingly narrow V-shaped channel 121 having a sharp v-shaped bottom. This gap 123 and the amount of center panel 122 exposed will vary greatly depending on the adjusted position of the spacing between the pads 110 and 112. The length of the pads 110 and 112, and specifically the sloped planar walls 118 and 120 must be long enough to catch enough of the length of the infant to properly and comfortably support the baby in a lateral or in the very least a semi-lateral position. The length of the sloped planar side wall which is positioned against the infant's back side is less critical than the length of the sloped planar side wall which is placed against the infant's front in the chest and stomach area. The side wall against the infant's chest should be sufficiently short in length relative to the infant so as to allow the infant when in the channel 121 to bring his legs forward toward his chest and into somewhat of a semi-fetal position, as newborns typically sleep with their legs curled as they did when in the womb. The length of the sloped planar side wall which is positioned against the infant's chest must additionally be sufficiently short that his face is free from engagement with the pad simultaneously with his legs being somewhat curled upward toward his chest as he lies on his side supported by the support pillow, see FIG. 4. The baby's face should not be blocked or engaged with the pad, as this might restrict breathing. The sloped planar side walls 118 and 120 in the example in FIG. 1 are positioned at a 45 degree slope, and this slope could vary somewhat such as between 30 and 75 degrees for example.

Figure 2:
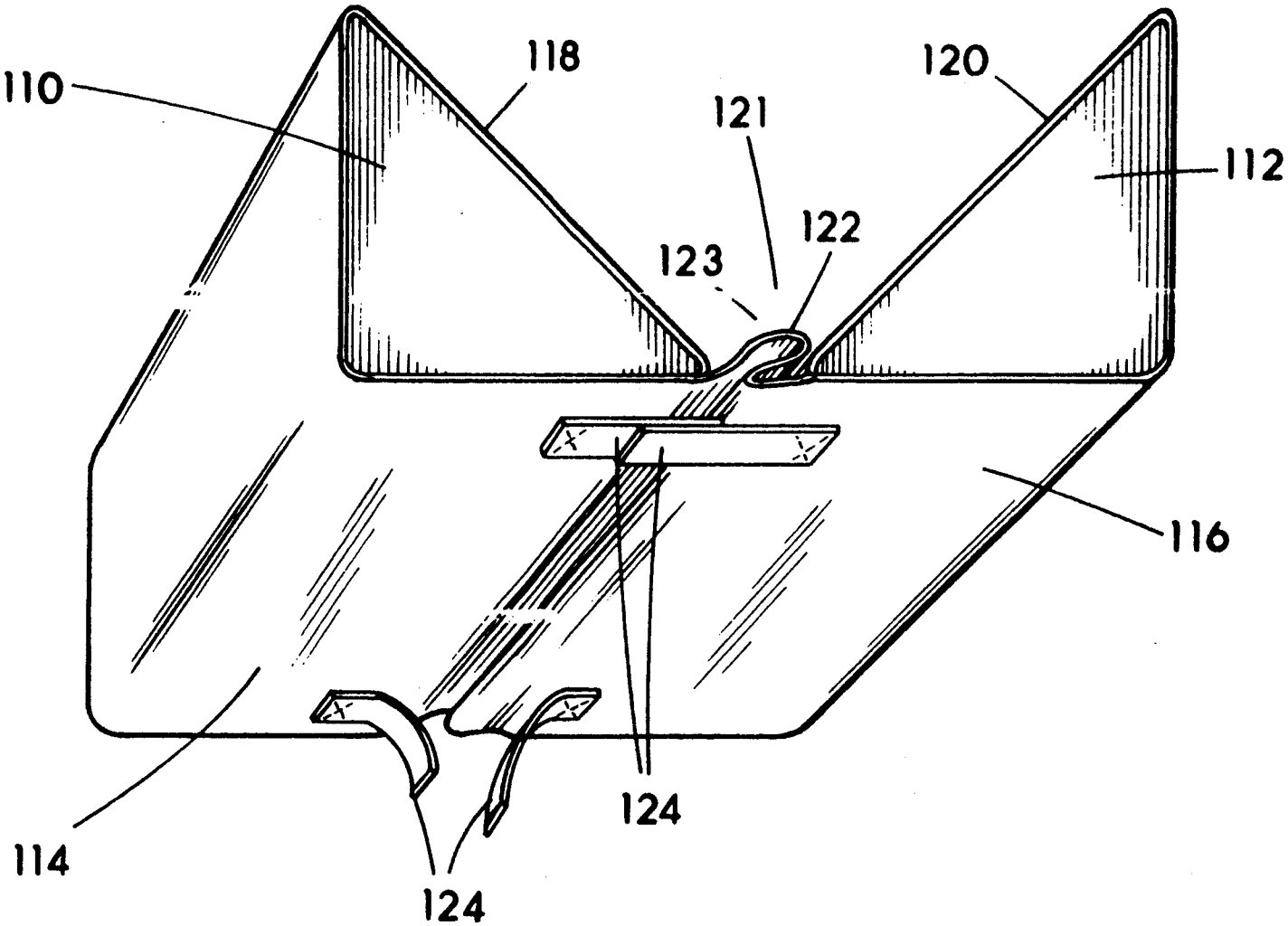
FIG. 2 is a slightly varied structural embodiment in accordance with my invention.

FIG. 2 is a slightly varied structural embodiment in accordance with my invention wherein the center panel 122 is a single piece of flexible material such as fabric, and to the bottom side of which mating sets of hook and loop fasteners 124 are sewn or otherwise attached across from one another so that the center panel 122 may be effectively shortened or widened with the fasteners 124. In the FIG. 2 drawing it can be seen that the center panel 122 is in essence somewhat bunched or folded, and this has closed the gap 123 somewhat compared to what it would be if the fasteners 124 were connected in a manner rendering less of a fold in center panel 124. The entire support pillow of FIG. 2 might be machine washable as a unit, or the padding of pads 110 and 112 which is preferably resilient foam might be removable from an outer material such as flannel or plastic-backed fabric.

Figure 3:
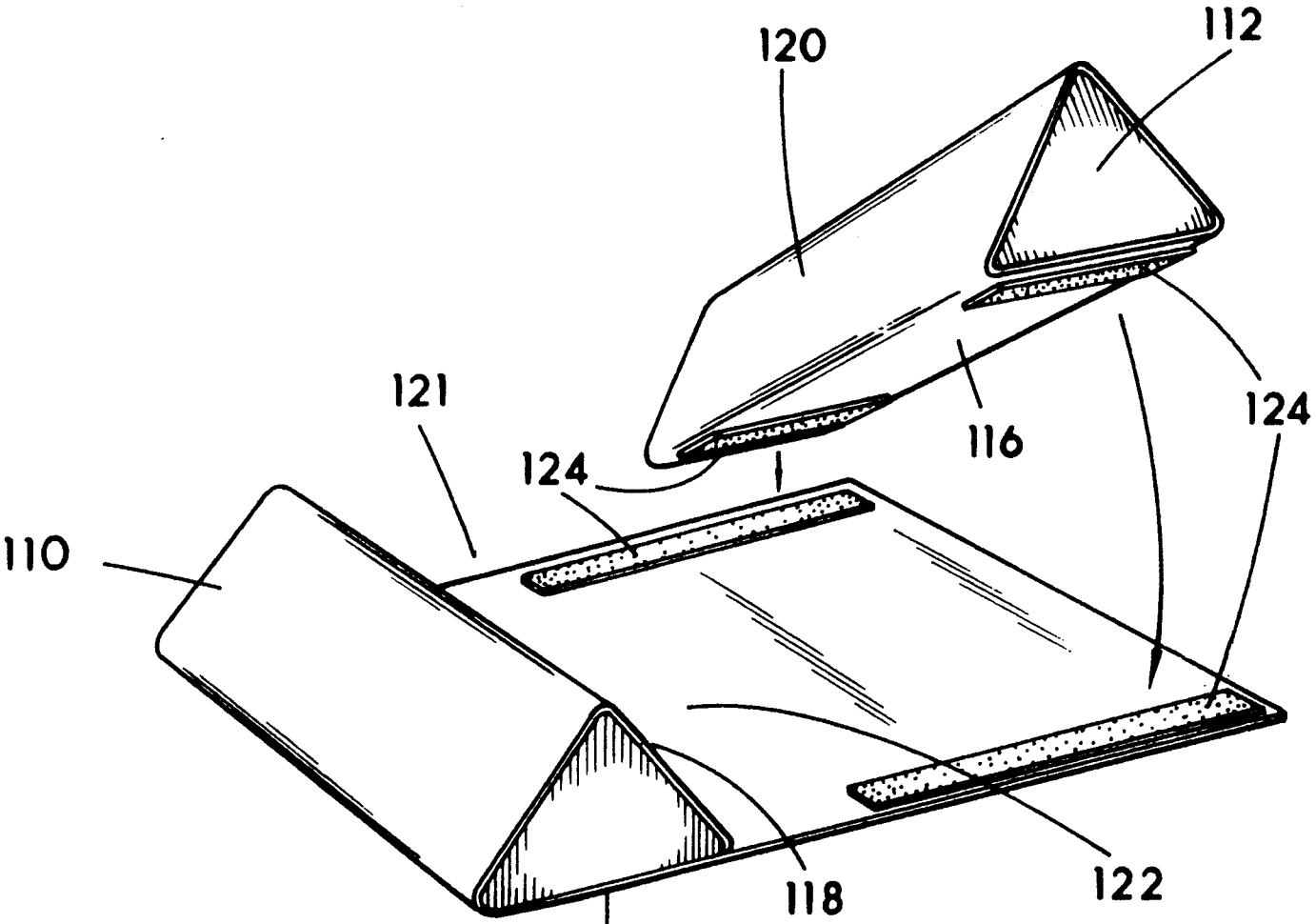
FIG. 3 is yet another slightly varied embodiment of my invention.

FIG. 3 is yet another slightly varied embodiment of my invention wherein center panel 122 attaches to and extends out from underneath pad 110 and has elongated strips of spaced apart hook and loop fasteners 124 on the top surface which are connectable with properly spaced strips of hook and loop 124 sewn or glued to the base 116 of pad 112 to allow the affixing of the pads stationary relative to one another and to allow for adjusting the width of the channel 121 and gap 123.

Figure 4:
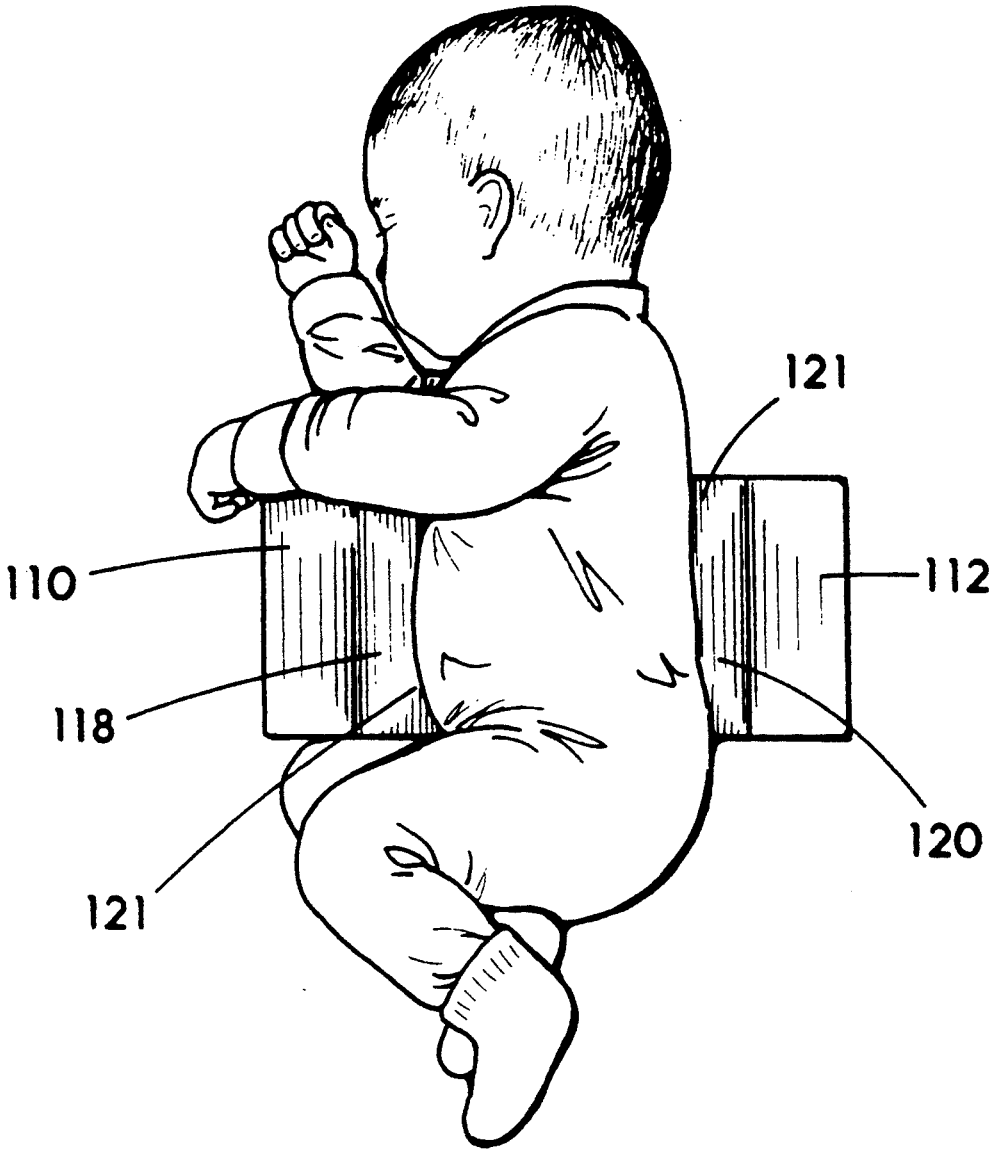
FIG. 4 is an in-use view of my invention.

FIG. 4 is an in-use view of my invention with an infant within the channel 121 being maintained on his side and with his legs somewhat drawn upward toward his chest and his face clear of pad 112.

Although I have very specifically described a preferred structure of the invention, it should be understood that the specific details are just that, "preferred", and given only for example to those skilled in the art. Many changes in the specific structures described may be made without departing from the true scope of my invention.

What I claim as my invention is:

1. A support pillow structured for maintaining a human infant generally on its side while sleeping, said support pillow comprising:

a first pad formed of a triangulated resilient foam member having an outer covering, said first pad having a sloped planar side wall connected to a substantially horizontally disposed planar base, a second pad formed of a triangulated resilient foam member having an outer covering, said second pad having a sloped planar side wall connected to a substantially horizontally disposed planar base, flexible connecting means spanning between the planar bases of said fist and second pads connecting the pads to one another, said flexible connecting means affixing said first and second pads so that the sloped planar side wall of each of the pads is sloping downward toward said flexible connecting means and defining a generally V-shaped channel, said V-shaped channel having an open top and two oppositely disposed open ends, said V-shaped channel being sufficiently wide in combination with the sloped planar side walls extending upward above said flexible connecting means in height at least equal to one-third the width of an infant's body so as to render said V-shaped channel able to receive and maintain an infant generally on its side within said V-shaped channel, a gap between the planar bases of the pads at a bottom of said V-shaped channel wherein at least a portion of said flexible connecting means is exposed between the planar bases of the pads in the bottom of said V-shaped channel so as to provide a non-pinching bottom area within said V-shaped channel in which an infant may rest, said first pad being sufficiently short in length relative to an infant so as to allow the infant when in said V-shaped channel with said first pad in the infant's chest area to bring his legs forward toward his chest while additionally having his face free from engagement with said first pad, stabilizing means for rendering said pads stationary relative to one another during use, with said stabilizing means being cooperative with adjustment means for providing adjustability in the width of said V-shaped channel for accommodating various sizes of infants, said support pillow having a generally flat anti-roll bottom defined by said horizontally disposed planar bases in combination.

2. A support pillow structured for maintaining a human infant generally on its side while sleeping, said support pillow comprising;

a triangulated first pad made of flexible and resilient foam substantially covered with fabric, said first pad having a sloped planar side wall connected to a substantially horizontally disposed planar base, a triangulated second pad made of flexible and resilient foam substantially covered with fabric, said second pad having a sloped planar side wall connected to a substantially horizontally disposed planar base, flexible connecting means spanning between the planar bases of said first and second pads connecting the pads to one another, said flexible connecting means affixing said first and second pads so that the sloped planar side wall of each of the pads is sloping downward toward said flexible connecting means and defining a generally V-shaped channel, said V-shaped channel having an open top and two oppositely disposed open ends, said V-shaped channel being sufficiently wide in combination with the sloped planar side walls extending upward above said flexible connecting means in height at least equal to one-third the width of an infant's body so as to render said V-shaped channel able to receive and maintain an infant generally on its side within said V-shaped channel, s gap between the planar bases of the pads at a bottom or said V-shaped channel wherein at least a portion of said flexible connecting means is exposed between the planar bases of the pads in the bottom of said V-shaped channel so as to provide a non-pinching bottom area within said V-shaped channel in which an infant may rest, said first pad being sufficiently short in length relative to an infant so as to allow the infant when in said V-shaped channel with said first pad in the infant's chest area to bring his legs forward toward his chest while additionally having his face free from engagement with said first pad, stabilizing means for rendering said pads stationary relative to one another during use, with said stabilizing means being cooperative with hook and loop fastener adjustment means for providing adjustability in the width of said V-shaped channel for accommodating various sizes of infant, said support pillow having a generally flat anti-roll bottom defined by said horizontally disposed planar bases in combination.

3. A support pillow structured for maintaining a human infant generally on its side while sleeping, said support pillow comprising;

a first pad formed of a resilient foam member having an outer covering, said first pad having a sloped planar side wall connected to a substantially horizontally disposed planar base, a second pad formed of a resilient foam member having an outer covering, said second pad having a sloped planar side wall connected to a substantially horizontally disposed planar base, flexible connecting means spanning between the planar bases of said first and second pads connecting the pads to one another, said flexible connecting means affixing said first and second pads to that the sloped planar side wall of each of the pads is sloping downward toward said flexible connecting means and defining a generally V-shaped channel, the flexibility of said flexible connecting means providing adjustability in the width of said V-shaped channel for accommodating various sizes of infants, said V-shaped channel having an open top and two oppositely disposed open ends, said V-shaped channel being sufficiently wide in combination with the sloped planar side walls extending upward above said flexible connecting means in height at least equal to one-third the width of an infant's body so as to render said V-shaped channel able to receive and maintain an infant generally on its side within said V-shaped channel, a gap between the planar bases of the pads at a bottom of said V-shaped channel wherein at least a portion of said flexible connecting means is exposed between the planar bases of the pads in the bottom of said V-shaped channel so as to provide a non-pinching bottom area within said V-shaped channel in which an infant may rest, said first pad being sufficiently short in length relative to an infant so as to allow the infant when in said V-shaped channel with said first pad in the infant's chest area to bring his legs forward toward his chest while additionally having his face free from engagement with said first pad, said support pillow having a generally flat anti-roll bottom defined by said horizontally disposed planar bases in combination.

* * * * *